US005456098A

United States Patent [19]

Hartwig et al.

[11] Patent Number: 5,456,098

[45] Date of Patent: Oct. 10, 1995

[54] PROCESS AND APPARATUS FOR CONTROLLING THE LOADING OF A PROCESSING MACHINE WITH BAND-LIKE MATERIAL

[75] Inventors: Thomas Hartwig, Egnach; Ingomar J. K. Summerauer, Arbon, both of Switzerland

[73] Assignee: Bruderer AG, Frasnacht, Switzerland

[21] Appl. No.: 198,547

[22] Filed: Feb. 18, 1994

Related U.S. Application Data

[63] Continuation of Ser. No. 775,806, Oct. 11, 1991, abandoned.

[30] Foreign Application Priority Data

Oct. 12, 1990 [CH] Switzerland ..... 3287/90

[51] Int. Cl.[6] ..... B21D 1/00; B21D 43/08

[52] U.S. Cl. ..... 72/129; 72/161; 72/183; 72/419

[58] Field of Search ..... 72/160, 161, 183, 72/129, 419, 361; 242/78.6, 105; 83/649, 65

[56] References Cited

U.S. PATENT DOCUMENTS

| | | | |
|---|---|---|---|
| 3,343,762 | 9/1967 | Ungerer | 242/78.6 |
| 3,381,913 | 5/1968 | Bachman | 242/78.6 |
| 3,422,653 | 1/1969 | Wiig | 72/161 |
| 3,834,204 | 9/1974 | Ihle | 242/78.6 |
| 3,991,462 | 11/1976 | Engel | 72/160 |
| 4,047,416 | 9/1977 | Johnson | 72/183 |
| 4,304,370 | 12/1981 | Box | 242/78.6 |
| 4,656,857 | 4/1987 | Tomita | 72/160 |
| 4,720,054 | 1/1988 | Hood | 242/105 |
| 4,863,112 | 9/1989 | Summerauer et al. | 242/78.8 |
| 4,923,138 | 5/1990 | Malkin | 242/78.6 |
| 5,054,304 | 10/1991 | Hayashi | 83/65 |

FOREIGN PATENT DOCUMENTS

| | | | |
|---|---|---|---|
| 0267357 | 5/1988 | European Pat. Off. . | |
| 2340149 | 9/1977 | France | 72/183 |
| 75827 | 6/1980 | Japan | 72/183 |
| 1557985 | 12/1979 | United Kingdom | 72/419 |

*Primary Examiner*—Daniel C. Crane
*Attorney, Agent, or Firm*—Ostrolenk, Faber, Gerb & Soffen

[57] ABSTRACT

For loading a processing machine with band-like material from a coil, a rotatable support, on which the coil rests with its axis substantially vertical, is driven by a motor. Since the circumference of the coil decreases during unwinding, a sensor is provided for controlling the motor to maintain a desired constant band speed.

31 Claims, 3 Drawing Sheets

PROCESS AND APPARATUS FOR CONTROLLING THE LOADING OF A PROCESSING MACHINE WITH BAND-LIKE MATERIAL

This is a continuation of application Ser. No. 07/775,806 filed on Oct. 11, 1991, now abandoned.

FIELD OF THE INVENTION

The invention relates to an automated process for controlling the loading of a processing machine with band-like material, and apparatus for this purpose.

DESCRIPTION OF RELATED ART

Processes of background interest are disclosed both in FR-A-2 340 149 and in EP-A-0 267 357 which disclose processes for gripping a band-like material provided from a coil, and then turning the material 90° into the proper position for further processing. EP-A-0267 357 corresponds to U.S. Pat. No. 4,863,112. In the first case, a welding machine is loaded and in the second case a punch press. The design according to the FR-A- involved many manual operations. First, the band was taken off manually from the coil at the beginning of operation and, likewise manually, fed through a turning zone, a hand lever being provided for turning a pair of guide rollers. Passage through a further pair of guide rollers was followed by shears and a welding machine, by means of which the successive band ends could be welded to one another in order to avoid repeated threading into the processing machine. Only then followed a pair of driven intake rolls, which subsequently permitted the band to be further conveyed in an automated manner.

In comparison, the design according to the stated EP-A- already had a higher degree of automation, since a take-off and turning apparatus was present downstream of the coil located in a cassette. By means of said apparatus, it was possible to grip the band end projecting from the coil cassette and pull a piece forward until it could be gripped by the clamps of a turning mechanism, which turned the band through 90° around its longitudinal axis while pulling it further forward. However, since the band length projecting from the cassette was variable and could sometimes be very short, the apparatus often had to make repeated gripping attempts. This made the control of the apparatus expensive and slowed down the loading process.

SUMMARY OF THE INVENTION

It is the object of the invention to make the loading process faster and more reliable and to permit simple automation which makes manual operation at least substantially superfluous. This aim is achieved by the features disclosed herein.

U.S. application No. 3,834,204 discloses a less desirable loading arrangement which manages without turning of the band. It is necessary with that arrangement to accept several disadvantages which are described in the above-mentioned EP-A-0 267 357. Those disadvantages are eliminated by a vertical position of the axis of the coil as in the present invention. In fact, in U.S. application No. 3,834,204 the coil axis is necessarily arranged horizontally so that—without turning—it will have the same orientation as the plane of the band-like material which must be fed horizontally through the straightening machine of a processing machine.

Once the band has reached the intake rolls of this straightening machine, according to the description in this U.S. application No. 3,834,204 synchronization should take place in the sense of a uniform distribution of the tension in the band. However, this means that synchronization cannot be guaranteed as long as there is a lack of tension between the pair of take-off rolls and the pair of intake rolls. Electric motors normally rotate at a higher speed when they are not under load, and it is for this reason that, in the known arrangement, the pair of intake rolls jerked the band in an undesirable manner on gripping the beginning of the band, even resulting in slipping and in failure of the loading process. If, on the other hand, the pair of intake rolls are found for any reason to have a lower speed than the take-off rolls, a band loop inevitably resulted, with the danger of entanglement of the band.

Of course, synchronization arrangements are known in principle, such as the one proposed by U.S. application No. 4,047,416—but only between the outlet end of the straightening machine and the downstream press and not between the pair of take-off rolls and the intake rolls.

Apart from achieving the object outlined above, an additional, advantageous effect of the present invention was found to be that the band-like material taken off in this manner had a lower level of internal stresses, with the result that the quality of the product was also improved.

In order to ensure the uniform feed of the band-like material to the take-off zone independently of the initial diameter of the coil, the tension of the band-like material is monitored and continued,involved many manual operations. First, since a certain delivery point in the take-off zone is arranged where by the further drive or the pair of take-off rolls receives the material from the coil.

The apparatus, according to the invention, for carrying out the process according to the invention has a rotatable coil support and a take-off and turning means which is downstream of the coil support and by means of which the band-like material can be taken off from the coil and then turned through 90° around its longitudinal axis, wherein the rotary drive means is coordinated with the coil support, and a sensor means for keeping the circumferential speed of the coil at least approximately constant is arranged in the region comprising the band transport and turning means and the coil and is connected to a drive control means.

A cutting tool and an actuator for the cutting tool are preferably provided near or on the processing machine. Advantageously, the pair of intake rolls located at the end of the loop zone can be driven in the opposite direction for withdrawing the band residue present in the feed of the processing machine, preferably via a program control means, which can then switch on the actuating drive of the cutting tool. These features are advantageous even independently of the process according to the invention and of the apparatus according to the invention, because it is thus ensured that the tool present in the processing machine can be rapidly removed, in particular in the case of faults or in order to install another tool and that, after the band has been cut off, no further run-out period is required for the processing machine in order to process a band residue. Such a band residue is avoided by carrying out cutting directly in the region of the processing machine. The end of processing and further loading is accelerated if the optional features are also provided.

A further concept, which is also advantageous independently of the process and apparatus according to the invention is that a loop zone having a loop guide, in particular at least one roller cage, is arranged in the region of the band take-off and turning means, and at least one part of the loop zone or of the take-off and turning means can be brought from a rest position into an operating position. By the combination of a loop zone with the take-off and turning means in one location, on the one hand space is saved since both apparatuses in any case are generally not operated simultaneously, the loop zone ensuring, after turning of the beginning of the band, that the following band lengths are turned automatically, and especially without stress, through 90° around the longitudinal axis of the band.

BRIEF DESCRIPTION OF THE DRAWINGS

Further details of the invention are given in the following description of embodiments illustrated in the drawings. The Figures each show a schematic cross-section. In the drawings.

DESCRIPTION OF EMBODIMENTS OF THE INVENTION

Figure 1:
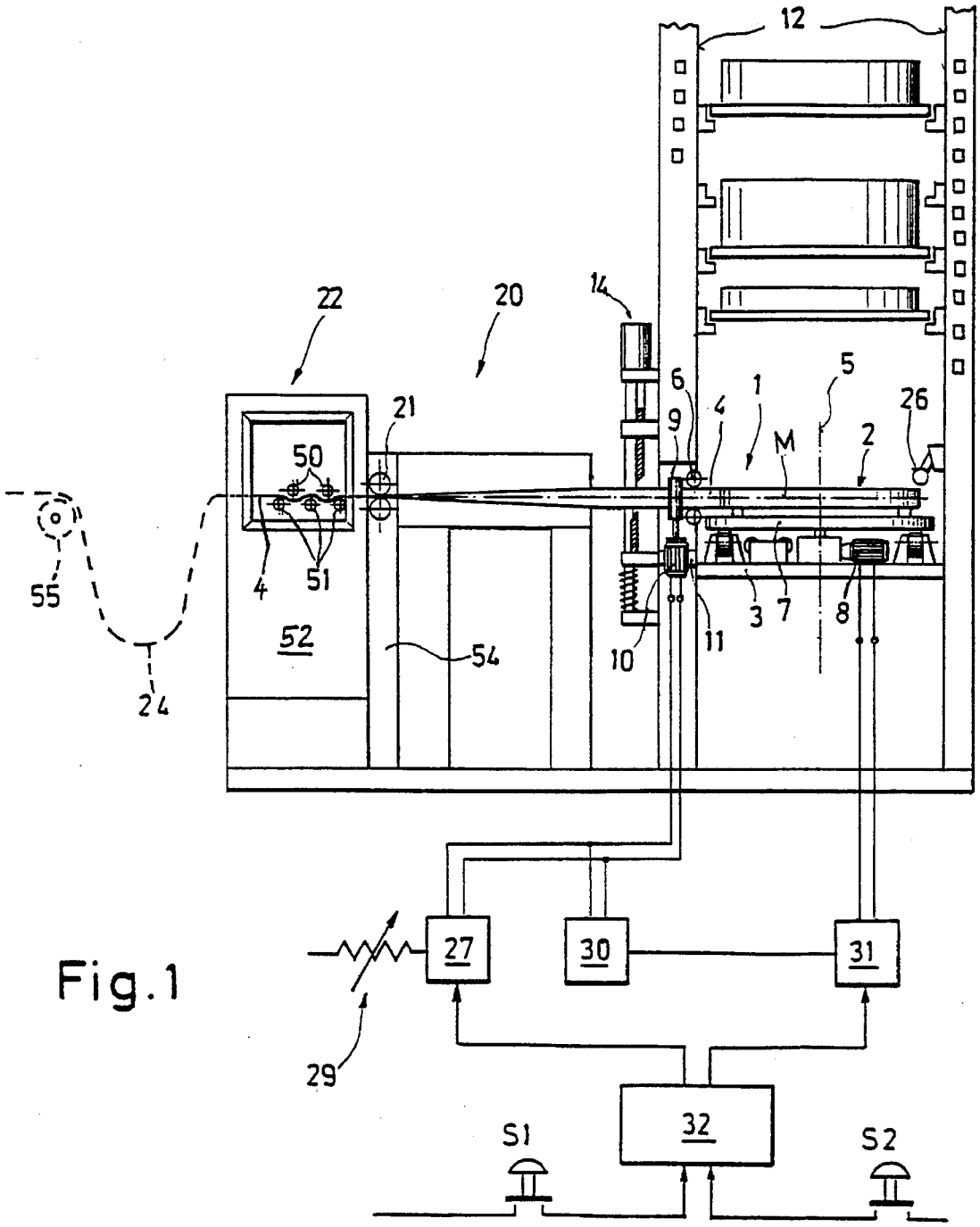
FIG. 1 shows a take-off and turning means 20 in combination with an unwinding station 1 for band-like material from a coil, a control and regulation, devices and a straightening machine 22 downstream thereof.

According to FIG. 1, an unwinding station 1 is provided for a coil 2 mounted on a lifting means 3. The details of the lifting means 3 and the control are described in U.S. patent application Ser. No. 07/775,277, now abandoned, tilled "Process for loading a processing machine having a fine centering step, and apparatus for this purpose" hereinafter referred to as "the '277 application," filed by the same applicant on Oct. 11, 1991, the same day as the present application, the content of which is herewith considered to be disclosed.

The band-like material 4 wound on the coil 2 lies in a vertical plane, according to the coil axis 5, and is first guided at both edges through guide rollers 6 when it is unwound by driving a turntable 7 provided on the unwinding station 1 with the aid of a motor 8.

A pair of take-off rolls 9, which are one behind the other and parallel to the plane of the drawing, is located directly downstream of the unwinding station 1. A drive motor 10 on a console 11, which is fastened to a support 12, is coordinated with this pair 9 of take-off rolls.

The pair 9 of take-off rolls is thus located in the immediate vicinity of the coil 2 or in the circumferential region of the coil, so that, when a drive 8 provided for said coil and described below is actuated, the automatic transfer of the beginning of the tape from the coil 2 to the pair of take-off rolls 9 is ensured in a simple manner, with the result that the band-like material 4 can be automatically threaded. A tool support (not shown in FIG. 1) mounted in a fixed manner either on a free-standing pallet winch or on the support 12 of the coil storage tower (magazine unit) is used in particular for this purpose. The edge guide rollers 6 are used for fine centering of the band 4 with respect to its neutral axis M.

Also shown in FIG. 1 are stated pair 9 of take-off rolls and/or shears 14 for cutting the band 4, in each case in the form of modular components.

Figure 2:
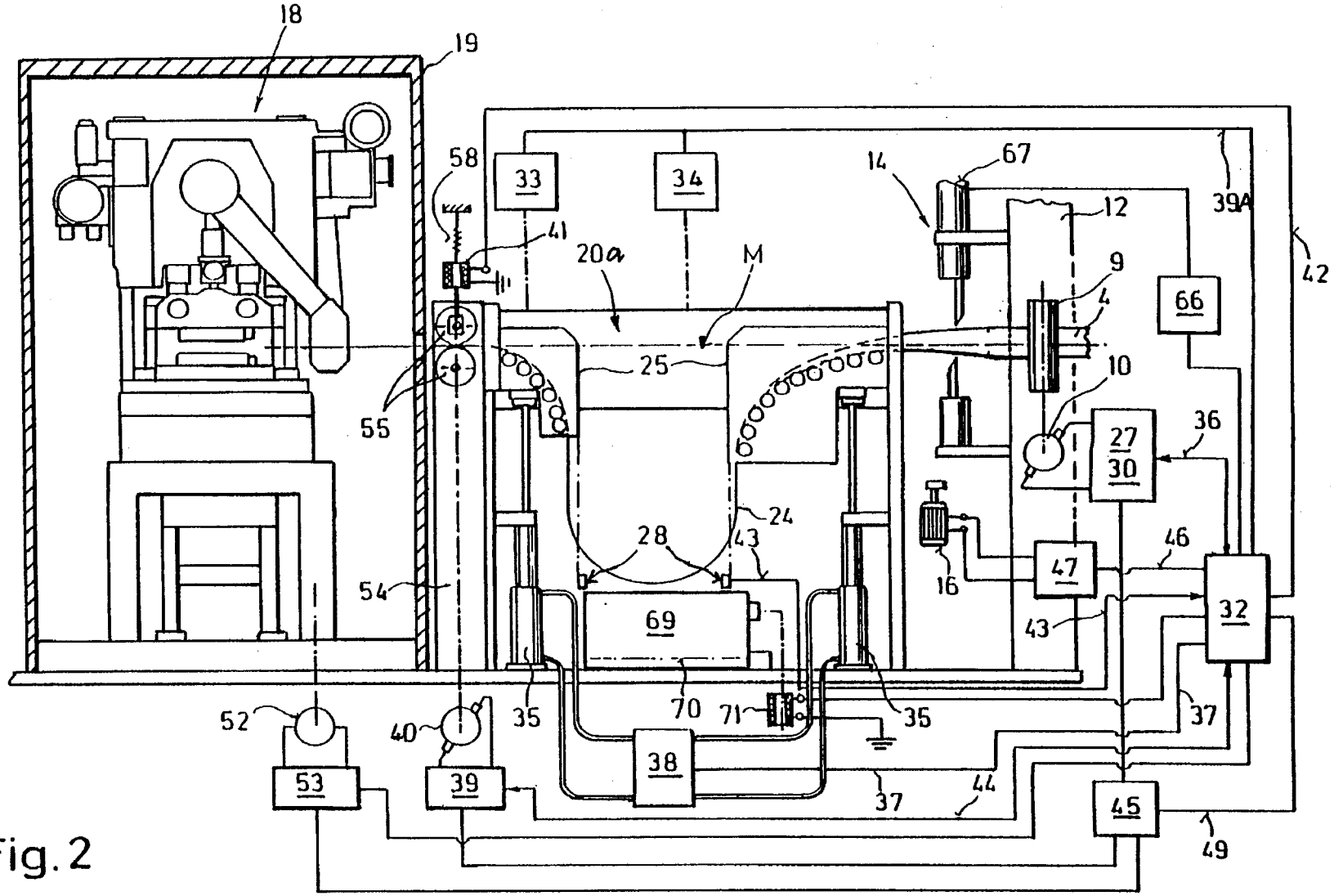
FIG. 2 shows a take-off and turning means 20*a* having combined turning and loop zone disposed between the unwinding station 1 and a downstream processing machine 18, no straightening machine being present, FIGS. 1 and 2 both showing take-off rolls, shears and centering means at the exit of the unwinding station 1; and introduction of the band-like material into a processing machine 18 which is, for example, a high frequency punch press.

The following representation—from right to left in FIG. 1—represents downstream shears 14, although it is clear that this representation, as in FIG. 2, in reality must be rotated 90° about a horizontal axis in the plane of the drawing. In principle, these shears 14 could also be omitted but, in order to accelerate the operation at the end of processing, it is expedient to include the shears 14, as will be evident from the description below.

Since the band 4 has to be brought into the horizontal position for infeed into the straightening machine 22 (FIG. 1), a take-off and turning means 20 which is preferably accommodated in a closed housing and may be designed similarly to the means shown in EP-A-0 267 357 (see FIG. 9 there) is furthermore provided. If necessary, a height adjustment means (or a lateral adjustment means) together with a coordinated motor or fluidic drive can also be provided for this take-off and turning means 20, as will be evident from the description below. In general, however, a rigid arrangement of this unit 20 is sufficient. As is evident from FIG. 2 and also disclosed in EP-A-0 267 357, this turning means 20 requires at least one drive for taking off the band 4 under tension, from the takeoff rolls 9 to a pair of take-off intake rolls 21 in front of a straightening machine 22 (FIG. 1) or a pair of intake rolls 55 directly into the processing machine 18 (FIG. 2) if the straightening machine 22 is dispensed with. The pair of intake rolls 21 or 55 is expediently housed in a separate side support 54, optionally in the form of a modular component.

Moreover, according to the invention, band 4 can be turned to the left or to the right, this being important in particular cases if, for example, the cutting burr is directed toward a certain side, rewinding then being unnecessary.

Since the coil 2 resting on the turntable 7 becomes increasingly small as a result of unwinding, the speed of the coil 2, optionally driven by the motor 8, must become higher and higher in order to keep the take-off speed of the band-like material 4 constant. One possibility would be to sense the circumference of the coil 2 with the aid of a stylus 26 and to control the speed of the motor 8 accordingly. In fact, however, the stylus 26 is also used for other purposes which are described in the simultaneously submitted, 277 patent application of the same applicant.

In this example, a further band take-off mechanism in the form of the take-off rolls 9 already mentioned with reference to FIG. 1 is in fact also provided. The revolutions of the motor 10 driving it are controlled by a control stage 27 in the sense that the speed is kept constant, so that band material 4 is fed uniformly to the straightening machine 22 or processing machine 18. The drive motor 8 thus conveys the band directly to the next constant drive 9, 10, without requiring an intermediate loop which could have a compensating effect, although this would also be possible within the scope of the present application.

It is expedient if a set-point adjuster 29, with the aid of which the speed of the motor 10 can be set, is coordinated with the control stage 27. If it is assumed that further band guide means are provided in the region of the centering rollers 6, for example the coil is mounted in a cassette, for example as described in EP-A-0 267 357, unwinding of the coil for loading the straightening machine 22 or the processing machine 18 can take place fully automatically from the point when the coil 2 is placed on the turntable 7.

In order to synchronize the two drive motors 8 and 10 with one another, a sensor whose output signal is fed to a control station 31 for the motor 8 is connected to the motor 10. For sensing at least one performance-determining parameter, such as voltage consumption or current consumption, this may be, for example, as shown in FIG. 1, a current sensor 30. However, it must be expected that, in certain cases, the power loss is so great that sensing the power consumption permits only very inaccurate control; for such cases, a conventional sensor is therefore preferred.

In order to ensure fully automatic operation, a program generator 32, for example a microprocessor, is provided, this Figure and the following Figures showing only those connections which are required for understanding the particular Figure. This program generator 32, which may also include other stages among those shown, such as parts of the control stages 27 and 31, has two inputs, each of which is connected to a respective switch S1 or S2. The program after the particular coil 2 has been placed on the turntable 7 is switched on by switch S1 to initiate a loading program, and an "end of loading" program is switched on by switch S2. Thus, as soon as the switch S1 is actuated, the two control stages 27 and 31 are put into operation and the motors 8 and 10 begin to run, the motor 8 being controlled as a function of the signal of the sensor 30. The motor 8 is therefore expediently a direct current or a synchronous motor.

As soon as the band-like material 4 has left the take-off rolls 9, it need only pass through the relatively narrow space of the shears 14 (which is shown excessively wide here). As described in EP-A-0 267 357, the band take-off (transport) and turning means 20 has a gripping mechanism which is connected to a sliding drive in order to pull the band 4 from the region of the take-off rolls 9 to the take-off intake rolls 21. At the same time, a rotation through 90° occurs, which rotation can take place, preferably, by means of a separate electric motor. Accordingly, the two control stages 33, 34 (FIG. 2) are coordinated with the turning means 20, of which, for example, the control stage 33 controls the sliding drive, which in particular is fluidic but may also be electric, and the control stage 34 controls the turning drive.

If a straightening machine 22 is provided in the system (FIG. 1), the band-like material 4 is turned before being introduced into said machine but there is no prior formation of a loop. In special cases, however, it may nevertheless be expedient, in order to facilitate synchronous control, also to include a loop zone before the straightening machine 22 in order to control the drive motors 8 and 10 by scanning said zone. The straightening machine 22 is provided in a conventional manner with upper and lower rollers 50, 51, between which the band 4 is bent in various directions (with smaller and smaller angles of wrap around the rollers 50, 51) in order to compensate internal stresses. A control stage (not shown) of the drive 52 of the rollers 50, 51 is advantageously connected to the synchronizing stage 45 (FIG. 2) for synchronization with the motors 10 (of the take-off rolls 9) and 40 (of the intake rolls 55).

If, on the other hand as in FIG. 2, the band take-off and turning means **20*a* is to go into action without a straightening machine 22, according to the invention it is open toward the bottom in order to permit the formation of a loop 24. Turning of the band 4** and loop formation then take place in a combined loop/turning zone.

A decision as to whether a plant is operated with or without a combined loop/turning zone, as described in the preceding paragraph and as shown in FIG. 2, depends on the type and dimension of the band-like material 4 to be processed: if it comprises thin and/or narrow bands, it is possible to operate with the preferred, combined loop/turning zone because no straightening machine is required as in FIG. 2; if the bands are broad and/or stiff, the turning zone is straight (as in FIG. 1) and a straightening machine 22 is required.

If the weight of the resulting loop 24 is sufficiently high, it may be possible to dispense with the take-off rolls 9 and drive only the turntable 7. Otherwise, a brake would be sufficient.

Referring now to the take-off/turning means **20*a*, a cylinder unit 35 is coordinated with each of two band guides 25, which are preferably in the form of roller cages in this embodiment of the invention in order to control the lowering of the band guides 25 at the moment when the beginning of the band is picked up by the pair 9 of the take-off rolls. Thus, as soon as the current consumption of the motor 10 deviates from the no-load current consumption, which indicates the arrival of the band 4 at this point, a signal is sent to the program generator 32 via the line 36, which generator in turn sends a start signal via a line 37 to a cylinder control stage 38 for lowering the band guides 25. Of course, instead of the sensor 30 serving a dual purpose here, it is also possible to provide any other sensor for the current consumption, if take-up of the band 4** is, for example, to take place later or, for other reasons, the arrangement of an optical, inductive or capacitive sensor (a pneumatic one would also be possible) is desired.

Simultaneously with the lowering or thereafter, a signal is transmitted via a line 39A in order to set the drives of the take-off and turning means **20*a* in operation. As soon as the take-off (gripping) and turning means 20*a* has brought the band 4 as far as the intake rolls 55, which once again can be communicated by a sensor to the program generator 32, for example by virtue of the fact that, here too, the control stage 39 for an intake roll drive motor 40 is combined with a power sensor, the following steps take place: The program generator 32 initially switches off the respective control stages 33, 34 for the sliding (take-off) and turning drives; if necessary, a corresponding drive (not shown) is switched on until the rest position of the means 20 is reached; the cylinders 35 are then actuated again in order to bring the band guides 25** back into the position shown. The subroutine for the loop formation program then begins.

For this purpose, it is necessary for the speed of the take-off rolls 9 to be greater than that of the intake rolls 55, i.e. it is preferable to switch off the latter completely, whereby they hold the band 4 clamped between them. These two intake rolls 55 are pressed together, for example, by a solenoid 41 (or any other means), which is supplied with current by the program generator 32 and an output line 42 at the beginning of the program (switch S1), but preferably not until the band 4 has reached the take-off rolls 9 (sensor 30), or optionally, however, not until a predetermined position of the take-off and turning drive **20*a*** has been reached.

Thus, if the drive of the intake rolls 55 was stopped while the take-off rolls a continue to transport band 4 to the loop guides 25, the loop of band 4 gradually increases in size until the loop sensing means 28, in the form of a light barrier, is covered by the band 4 and thus transmits a negative signal via a line 43 to the program generator. This ends the loop formation subroutine.

After the end of loop formation, the drive 40 for the intake rolls 55 is switched on again in order to convey the band 4 into the processing machine 18 (FIG. 2). For this purpose, a corresponding command is sent by the program generator 32 via a line to the motor control stage 39, the synchronizing circuit 45 ensuring synchronization of the two motors 10 and 40.

In comparison, in the embodiment of FIG. 1 the drive 40 for the intake rolls 21 remains switched on in the case of a stretched type of take-off and turning means 20 according to FIG. 1 after the end of loop formation (not shown) upstream of the straightening machine 22, and is synchronously controlled by sensors which are analogous to those for the combined loop and turning zone 20*a* as shown in FIG. 2.

It should also be borne in mind that the simple frictional drive by the rolls 9 or 55 generally involves slip. To maintain the loop size, it is therefore necessary for the peripheral speed of the intake rolls 55 to be slightly greater than that of the take-off rolls 9. This can be effected in various ways. On the one hand, the signal of the loop monitor 28 can be used for this purpose, in order to initiate a faster speed of motor 40 via the program generator when the light barrier is covered to a greater extent. However, it is also possible for the synchronizing means 45 to be designed in such a way that it deliberately allows the motor 40 to run at a higher speed, for example at a speed about 2% higher, i.e. only "quasi-synchronizes" it. However, the simplest method involves achieving a higher peripheral speed of the rolls 55 by means of a slightly larger diameter of said rolls (compared with that of take-off rolls 9), since this simplifies the electrical control. This also ensures the band tension between take-off rolls 9 and intake rolls 55 in FIG. 2, before loop formation, or between take-off rolls 9 and take-off/intake rolls 21 or in the case of FIG. 1.

However, before the loop formation subroutine begins, a centering subroutine can also be initiated if the plant described is provided with a height adjustment means, as described in the parallel 277 application. In this case, a command can be sent via the line 46 to a control stage 47 for triggering the centering subroutine, for example before actuation of the take-off and turning means 20*a* and fastening of the band between the clamping and non-operating intake rolls 55, the two centering rollers 6 (FIG. 1) being driven by the motor 16 (FIG. 2) toward the edges of the band 4 in order to bring the latter to a central plane M corresponding to the machine 18 (FIG. 2) (the so-called neutral axis of the band 4). The parallel 277 application states that the roller cage 25 facing the unwinding station 1, together with the turntable 7 (FIG. 1), is displaced in order to reach this central plane. However, this centering step is omitted if centering is carried out in the manner described in EP-A-267 357. As soon as the centering means 6 has completed its work, the centered position, and hence the end of the subroutine, is detected by sensors.

Thus, if the band 4 has now reached the intake rolls 55 and a loop 24 has been formed, the synchronizing circuit 45 ensures synchronized operation of the motors 10 and 40, it being expedient if the synchronizing stage 45 is connected to the program generator 32 via a line 49 in order also to put this stage out of operation when the drive of the intake rolls 55 is switched off.

As soon as the band-like material leaves the straightening machine 22, it passes through a simple loop zone which is designed without turning of the band 4 and is not shown here and for which the subroutine which runs for formation of the loop is essentially the same as that described with reference to the loop zone 24, and enters the processing machine 18; this is, for example, a high frequency punch press surrounded by a sound-insulating housing 19 owing to the high punching frequencies. A pair 55 of intake rolls (FIG. 3) arranged on the entrance side of the insulated housing 19 may be provided, to which pair of rolls the band 4 is fed after the loop program; however, the loop may also be formed in any desired manner. The intake rolls 55 can also be used for retracting the band residue from the processing machine 18 at the end of a processing operation.

Figure 3:
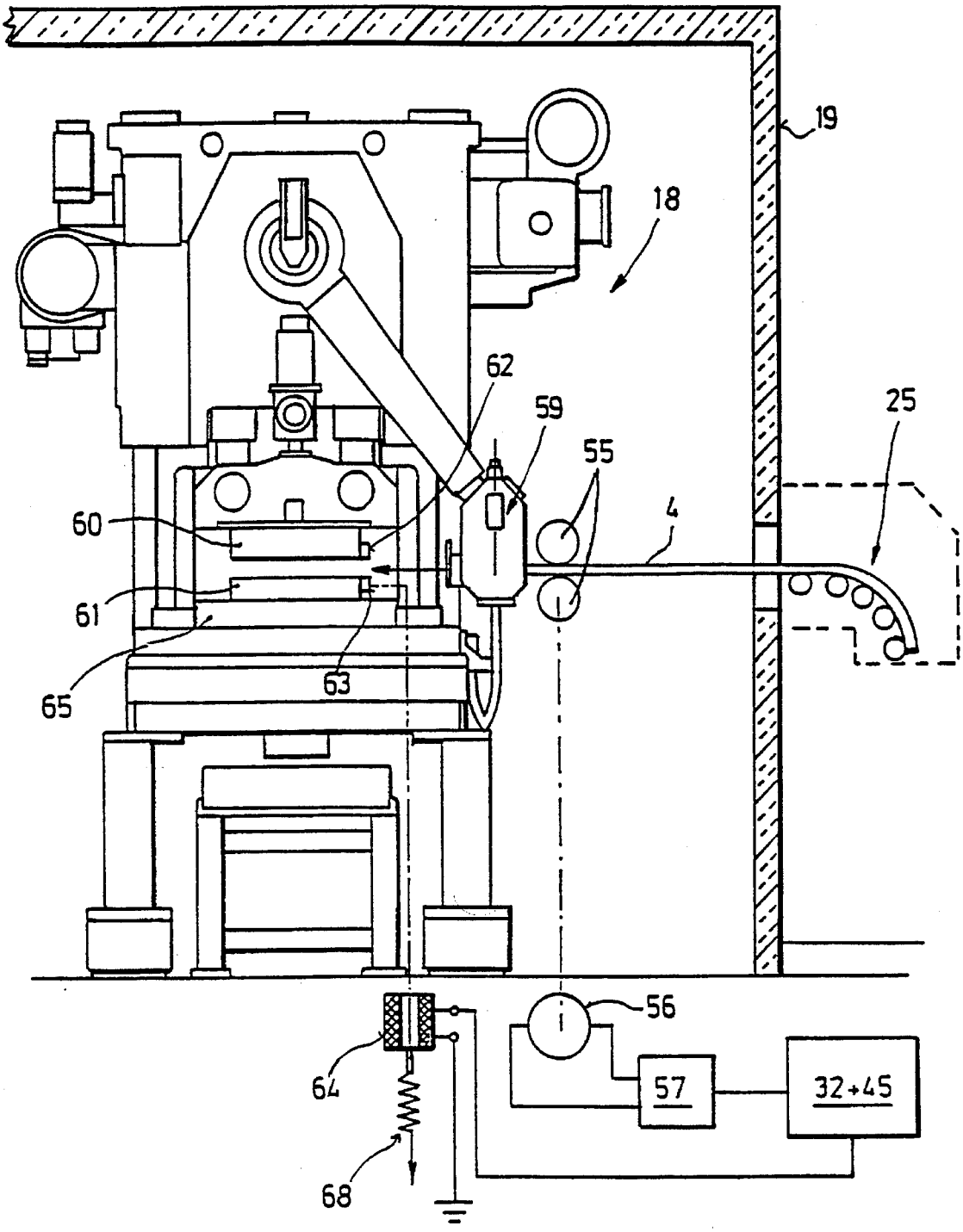
FIG. 3 shows the area of the processing machine 18.

If the arrangement without a straightening machine 22 is preferred, the intake rolls 21 can perform the function of the pair 55 of intake rolls. The intake rolls 55, too, can be pressed against one another by means of a drive, such as the magnet 41 (cf. FIG. 2), in order to equip the plant alternatively with or without a straightening machine 22 and, in the latter case, to be able to switch off the intake rolls 55. FIG. 3 also shows that an intake roll motor 56 is provided, the control stage 57 of which is controlled or synchronously controlled by the program generator 32 or the synchronizing stage 45, respectively.

In principle, a pair of intake rolls is required only once the infeed of the band 4 into the processing machine 18 is complete. The control stage 57 can therefore also be connected to a load sensor in order to inform the program generator 32 of the arrival of the band 4 at the intake rolls 55. The sensor of another type can also perform this. The magnet 41 (FIG. 2) is then again deenergized so that the upper intake roll 21 lifts off the lower one under the action of a tension spring 58, or the intake roll 21 is rendered ineffective. The band 4 is now processed in a conventional manner by the punch press 18 until either a step counter installed at 59 indicates that a preset number of punched parts has been reached and (instead of the switch S2 in FIG. 2) an "end" signal is transmitted to the program generator 32, or the switch S2 is actuated by hand.

The "end" signal produced by the counter or by the hand triggers a particular subroutine of the program generator 32. First, the band 4 has to be cut. This can be effected in various ways. Either the shears 14 (FIG. 1, 2) are used for this purpose and the band residue up to the punch press 18 is further processed. Moreover, a cutting tool 62, 63 may be provided on the machine 18 itself if this processing is impossible for whatever reasons. These cutting tools 62, 63 are then provided directly on the machine 18 and come into operation when the band end cut off by the shears 14 (at the end of the processing order) has reached a point exactly between the take-off rolls 55 (or 21 if no straightening machine 22 is provided). The take-off rolls 55 or 21 then pull the short band residue back so that the next band start can again be fed in automatically.

The cutting tool 62, 63 in the processing machine 18 can also go into operation when a fault has occurred or for a particularly valuable, for example silver-plated, band; the band 4 can then be withdrawn over the entire loop zone 24.

It is therefore particularly advantageous if shears are arranged in the direct vicinity of the punch tools 60, 61. FIG. 3 schematically shows two shear parts 62, 63. Of these, the shear part 62 fastened to the upper tool 60 is, for example, rigidly attached, whereas the other shear part 63 can be moved from a rest position, in which it is in the inactive position and the band 4 can run unhindered past the two parts 62, 63 or between them, into an operating position, in order to cooperate with the shear part 62 for cutting the band 4.

A drive magnet 64 (or any other suitable drive, possibly also a fluidic one) is provided for this purpose, said magnet expediently being arranged, together with the other parts for the shear part 63, as one module on a mounting plate 65 in order to permit subsequent fastening to any tool 61. The shear part 62 (which may optionally also be of a different form and, if desired, may likewise be movable) is fastened in a similar manner to the upper tool part 60.

When it receives the "end" signal, the program generator 32 will therefore ensure that the magnet 64 is briefly energized in order to effect cutting of the band 4, so that a band residue remains only in the tool itself. On the other hand, a band residue is present toward the coil 2, and two procedures are possible. Either the program generator sends a command, after the band 4 has been cut, into the motor control stages to reverse the direction of rotation so that the entire band residue is conveyed back to the coil 2 and is rewound. The rollers 50, 51 of the straightening machine can be moved apart (the drive for this purpose is not shown) in order to facilitate rewinding.

Since such a rewind program normally takes a certain time and this time is not generally available, the shears 14 are expediently also provided in addition to the shears 62, 63 and, simultaneously with the latter, receive the command to cut the band from the program generator 32. While the take-off rolls 9 can if necessary be put out of operation, the upstream drives, i.e. the motor 56 (unless the intake rolls 55 have been omitted and are replaced by the intake rolls 21), the motor 52 (unless the straightening machine has been omitted or the rollers 50, 51 are moved apart) and in any case the motor 40, receive the command to convey the band 4 backward. In order to be able to carry out this step, the shears 14 are controllable by the program generator 32 via control stage 66 for a shears drive 67 (FIG. 2) which is shown schematically and which is, for example, a fluid drive or optionally an electric motor drive (spindle drive). It is also evident that the shears 62, 63 can be activated for only a short time since, after discontinuation of an energizing current at the magnet 64, a restoring spring 68 ensures that the shear part 63 returns to its rest position indicated by solid lines. It should be mentioned that a spiral shape of the part 63 facilitates cutting, and in fact such curved shapes (as well as other arcs) are frequently encountered in shears.

A collecting trough 69 (FIG. 2), which is pivotable, for example, about an axis 70 in order to load the band residue onto a conveyor (not shown), is provided on the underneath of the loop zone 24. A drive, for example in the form of a solenoid 71, is provided for this purpose, which drive, after the end of the procedure for conveying the band 4 back into the trough, expediently after expiry of a sufficient time determined by the pulse generator of the program generator 32, tilts the trough and empties the band residue onto the stated conveyor or into a waste container. The system is now ready to carry out a further loading program.

It is easily understandable that the combination of the loop 24 with the take-off and turning means 20 has particular advantages. This is because, after turning of the band-like material 4 by the band transport and turning means 20 and transfer to the pair 21 or 55 of intake rolls, the loop 24, as shown in FIG. 2, ensures, automatically and especially without stress, that the band 4 entering the loop 24, in the vertical plane, is constantly turned through 90° about its longitudinal axis. Of course, this effect is also obtained in principle in the case of a taut band, but the turning procedure results in different pressures of the edges on the particular pair of rolls, i.e. one edge will act to a greater extent on one roll and the other edge will press to a greater extent on the other roll, and different slip conditions and hence once again internal stresses in the band may result. This effect is further reinforced by virtue of the fact that the turning procedure imposes a load on the particular pair 9 or 21 of rolls and attempts to move them apart. Viewed in this way, the combination of loop and turning zone is also advantageous when the band 4 is taken off not by the motor 8 but in a conventional manner.

It is advantageous if the take-off clamp arranged in such a band transport and turning zone is synchronized with the pair of take-off rolls, a synchronizing unit being connected to the motor of the latter. In order to understand this, reference is made here expressly to the disclosure of U.S. Pat. No. 4,863,112 (corresponding to EP-A-0 267 367) and its FIG. 9, which disclosure is incorporated in this description by reference. This FIG. 9 shows a take-off clamp cp which, in order to transport the band, first travels toward the coil, grips the band there in the region of its projecting end by closing the clamp and then travels forward toward a pair of intake rolls ro. This latter transport movement (during which turning of the band through 90° takes place at the same time) should thus be synchronized by the stated synchronizing means with the motor of the pair 9 of take-off rolls.

Depending on the degree of automation, the program generator will be entrusted with a greater or smaller number of control tasks among the functions mentioned in the above description, i.e. it is of course not necessary for all the connections described to be realized as part of the invention.

Moreover, the advantages, discussed above with reference to FIG. 3, of shears arranged in the region of the tool and displaceable from the rest position to the operating position are of course also obtained when the coil 2 is driven by a means other than the motor 8, for example by simple pulling by means of take-off rolls 9. Such shears may, for example, also comprise only one blade 63, the mobile one, which, in its operating position, cooperates with a cutting edge of the tool itself. For the movable blade, the tool can, if desired, also have ground guide surfaces in which the tool can, for example, be moved (for example into a groove).

We claim:

1. A process for controlled feeding of a processing machine with band-like material having a free end, from a coil having a winding axis, in order to effect a processing operation, the process comprising the steps of:

supporting the coil on a support in a substantially horizontal plane with said axis being substantially vertical;

rotating said coil substantially about said axis by drive means so that said free end of the band-like material is moved;

gripping said free end between a pair of take-off rollers rotationally driven about substantially vertical axes by drive means and arranged near said coil in its circumferential region and at said plane, so as to have said free end extending in a substantially vertical plane;

turning said free end around its axis downstream of said take-off rollers;

feeding said free end thereafter to at least one pair of intake rollers driven to rotate about substantially horizontal axes by drive means;

feeding said free end to processing machine;

forming a freely suspended loop suspended of said band-like material between said take-off rollers and said processing machine; and processing said band-like material at said processing machine downstream of said pair of intake rollers.

2. A process as claimed in claim 1, wherein the step of turning is effected while said material is between said take-off rollers and a pair of additional rollers supported downstream from said take-off rollers, and wherein said loop is formed downstream from said additional rollers.

3. A process as claimed in claim 2, wherein said band-like material passes through a straightening machine comprising rollers driven by a drive means downstream from said pair of additional rollers and before said loop is formed.

4. A process as claimed in claim 1, wherein the step of turning by 90° degrees is effected while said loop is formed.

5. A process as claimed in claim 1, further comprising the step of sensing a parameter representative of the tension of said band-like material between said coil and said pair of take-off rollers and re-adjusting at least one of said drive means of said coil and of the take-off rollers so as to achieve synchronization between the take-off speed of said band-like material and the circumferential speed of said take-off rollers to prevent loop formation of said band-like material therebetween.

6. A process as claimed in claim 1, wherein the step of turning by 90° is effected while said material is between said cake-off rollers and a pair of additional rollers supported downstream from said takeoff rollers, and wherein said loop is formed downstream from said additional rollers, further comprising the step of sensing a parameter representative of the tension of said band-like material between said coil and said pair of take-off rollers and re-adjusting at least one of said drive means of said coil and of the take-off rollers so as to achieve synchronization between the take-off speed of said band-like material and the circumferential speed of said take-off rollers to prevent loop formation of said band-like material therebetween, and further comprising the steps of sensing and synchronizing the circumferential speeds of said take-off rollers and of said additional rollers.

7. A process as claimed in claim 1, wherein the step of turning is effected between said take-off rollers and a pair of additional rollers supported downstream from said take-off rollers, and wherein said loop is formed downstream from said additional rollers, and wherein said band-like material passes through a straightening machine driven by a drive means after said pair of additional rollers and before said loop is formed, further comprising the step of sensing a parameter representative of the tension of said band-like material between said coil and said pair of take-off rollers and re-adjusting at least one of said drive means of said coil and of the take-off rollers so as to achieve synchronization between the take-off speed of said band-like material and the circumferential speed of said take-off rollers to prevent loop formation of said band-like material therebetween, further comprising the steps of sensing and synchronizing the driving motion of said additional rollers so as to achieve synchronization between the circumferential speeds of said take-off rollers and of said additional rollers, wherein said synchronizing step further comprises the step of synchronizing said drive means of the straightening machine.

8. A process as claimed in claim 7, wherein said loop forming step includes the steps of monitoring the size of said loop prior to entry of said band-like material into said processing machine, deriving a signal indicative of the size of said loop, and using said signal for adjusting at least one of said drive means, while maintaining said synchronization.

9. A process as claimed in claim 1, further comprising the step of disengaging at least one pair of said intake rollers, as soon as said band-like material has reached said processing machine.

10. A process as claimed in claim 1, further comprising the step of ending said processing operation by cutting said band-like material upstream of and near said processing machine, and rotating at least one of said drive means in reverse direction so as to pull back said band-like material towards said coil.

11. A process as claimed in claim 10, wherein said band-like material is cut off by two cuts, one downstream of said take-off rollers and One near said take-off rollers.

12. A process as claimed in claim 10, wherein the residue of said band-like material between the two cuts is removed in the region of said loop.

13. A process as claimed in claim 12, wherein said cut downstream of and near said take-off rollers is carried out first, the band-like material continues to be fed to said processing machine until the cut band end of said band-like material reaches intake rollers provided near the processing machine, whereafter the cutting step upstream of and near said processing machine and downstream of and near said intake rollers is effectuated, and the drive means of said intake rollers is rotated in reverse direction so as to pull back said band residue.

14. A process as claimed in claim 1, wherein at least one of said rollers is driven with a slightly higher circumferential speed than the roller or coil upstream of and next to said at least one of said rollers in order to avoid the formation of a loop between said rollers.

15. A process as claimed in claim 3, wherein at least one of said rollers is driven with a slightly higher circumferential speed than the roller or coil upstream of and next to said at least one of said rollers in order to avoid the formation of a loop between said rollers.

16. An apparatus for feeding band-like material having a free end which extends in a substantially vertical plane, from a coil having a substantially vertical winding axis, said band-like material being fed to a processing machine in order to be subjected to a processing operation, the apparatus comprising:

a coil station including a rotatable coil support rotatable about a substantially vertical axis providing a substantially horizontal support surface for receiving said coil;

drive means at said coil station for rotating said coil substantially about said axis;

take-off rollers arranged at said coil station rotatable about substantially vertical axes so as to grip said free vertically extending end;

take-off drive means for driving said take-off rollers;

turning means for gripping said free end, taking it off said take-off rollers and turning it into a substantially horizontal plane in order to enable processing;

at least one pair of intake rollers rotatable about substantially horizontal axes arranged to receive said free end after it has been turned into said substantially horizontal plane;

intake drive means for rotating said intake rollers;

drive control means for controlling at least one of said drive means; and a processing machine downstream of said intake rollers for processing said band-like material; and further comprising:

loop forming means for guiding said band-like material to form a freely suspended loop of said band-like material disposed between said take-off rollers and said processing machine.

17. Apparatus as claimed in claim 16, further comprising sensor means for monitoring a parameter representative of any differences of speed between at least two of said drive means, said sensor being connected to said drive control means to synchronize said at least two drive means.

18. Apparatus as claimed in claim 17, wherein said drive control means is connected to control said coil drive means, whereas the speed of the drive of said take-off means is substantially kept constant.

19. Apparatus as claimed in claim 17, wherein said sensor means comprises performance sensing means for sensing at least one performance parameter of a drive means.

20. Apparatus as claimed in claim 19, wherein said performance sensing means comprises a current consumption sensor.

21. Apparatus as claimed in claim 17, further comprising synchronizing means for synchronizing the speed of said support means with at least one further drive means downstream, when seen in the direction of movement of said band-like material.

22. Apparatus as claimed in claim 16, wherein additional rollers are provided, downstream of said take-off rollers, having a slightly larger diameter than the take-off rollers in order to compensate for slip between said band-like material and the additional rollers.

23. Apparatus as claimed in claim 16, further comprising at least one cutting means for cutting said band-like material at the end of said processing operation, said cutting means being provided at least near said processing machine.

24. Apparatus as claimed in claim 23, further comprising drive reversal means for withdrawing a band residue remaining after said band-like material has been cut by said cutting means near said processing machine.

25. Apparatus as claimed in claim 16, wherein said drive control means comprises programming means for effecting a programmed sequence of operation modes of said drive means.

26. Apparatus as claimed in claim 25, further comprising:

cutting means for cutting said band-like material at the end of said processing operation, said cutting means being provided at least near said processing machine and having an operative position and an inoperative position; and actuating drive means for moving said cutting means from one of its positions into the other, drive reversal means for withdrawing a band residue remaining after said band-like material has been cut by said cutting means;

wherein said programming means is connected to said cutting means and said reversal means for controlling them.

27. Apparatus as claimed in claim 26, wherein said programming means has a starting program stored therein to first start said coil drive means to move said free end towards said take-off means and driving said take-off means with a higher speed than that of said coil drive means, thereby avoiding the formation of a loop of said band-like material between them.

28. Apparatus as claimed in claim 26, wherein said intake drive means, to effect a higher speed of said take-off means for loop forming, is disengaged by said programming means.

29. Apparatus as claimed in claim 28, further comprising displacing means for selectively moving said intake rollers apart from each other to disengage them, said programming means being connected to said displacing means for controlling the same.

30. Apparatus as claimed in claim 29, wherein the program of said programming means is to move said displacing means into the disengaged position after said band-like material has reached said processing machine.

31. Apparatus as claimed in claim 16, wherein at least one of said loop forming means, said take-off means and said turning means has an inoperative position for freeing space and enabling said material to have access to another one of said means, and an operative position to engage said band-like material.

* * * * *